US011780060B2

(12) United States Patent
Kusumoto et al.

(10) Patent No.: US 11,780,060 B2
(45) Date of Patent: Oct. 10, 2023

(54) IMPACT WRENCH

(71) Applicant: MAKITA CORPORATION, Anjo (JP)

(72) Inventors: Kihiro Kusumoto, Anjo (JP); Tokuo Hirabayashi, Anjo (JP); Yuya Sano, Anjo (JP); Koji Kasugai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 510 days.

(21) Appl. No.: 16/928,466

(22) Filed: Jul. 14, 2020

(65) Prior Publication Data

US 2021/0060741 A1 Mar. 4, 2021

(30) Foreign Application Priority Data

Aug. 29, 2019 (JP) ..... 2019-157153

(51) Int. Cl.
*B25B 21/02* (2006.01)
*B25F 5/02* (2006.01)

(52) U.S. Cl.
CPC ..... *B25B 21/02* (2013.01); *B25F 5/02* (2013.01)

(58) Field of Classification Search
CPC ... B25B 21/02; B25B 21/026; B25B 23/0035; B60B 29/006; B23P 19/06; B25F 5/02
USPC ..... 173/93, 93.5, 122, 205
See application file for complete search history.

(56) References Cited

U.S. PATENT DOCUMENTS 5,038,869 A * 8/1991 Olson ..... F16D 1/06 81/177.85
7,036,406 B2 * 5/2006 Milbourne ..... B25B 21/026 81/177.85
7,249,638 B2 * 7/2007 Bodine ..... B25B 21/02 173/171
7,980,321 B2 * 7/2011 Happ ..... B25B 21/023 173/128
8,342,061 B2 * 1/2013 Super ..... B25B 15/001 81/177.85

(Continued)

FOREIGN PATENT DOCUMENTS

CN 1672879 A 9/2005
CN 102083594 A 6/2011

(Continued)

OTHER PUBLICATIONS

Mar. 7, 2023 Office Action issued in Japanese Patent Application No. 2019-157153.

(Continued)

*Primary Examiner* — Hadi Shakeri
(74) *Attorney, Agent, or Firm* — Oliff PLC

(57) ABSTRACT

An anvil receives less stress around a rectangular prism and has higher durability. An impact wrench includes a motor, a hammer rotatable by the motor, a body accommodating the motor and the hammer, and an anvil protruding frontward from the body and to be struck in a rotation direction by the hammer. The anvil includes a blade to be in contact with the hammer, a cylinder located frontward from the blade, a rectangular prism located frontward from the cylinder, at least one chamfered surface each at an edge of the rectangular prism, and a concave on a rear end of the at least one chamfered surface.

18 Claims, 7 Drawing Sheets

(56) References Cited

U.S. PATENT DOCUMENTS

| | | | | |
|---|---|---|---|---|
| 8,839,879 | B2 * | 9/2014 | Elger | B25D 17/005 173/132 |
| 2005/0022638 | A1 | 2/2005 | Milbourne et al. | |
| 2008/0087448 | A1 * | 4/2008 | Happ | B25B 21/023 173/93 |
| 2009/0223690 | A1 * | 9/2009 | Sugimoto | B25B 21/026 173/48 |
| 2011/0056714 | A1 | 3/2011 | Elger et al. | |
| 2014/0260826 | A1 * | 9/2014 | Eggert | B25B 13/06 81/177.85 |
| 2017/0326719 | A1 * | 11/2017 | Ueda | B25D 17/26 |
| 2022/0111497 | A1 * | 4/2022 | Sano | B25B 21/02 |

FOREIGN PATENT DOCUMENTS

| | | | |
|---|---|---|---|
| JP | 2005-279922 | A | 10/2005 |
| JP | 2018-001314 | A | 1/2018 |
| JP | 2018-183835 | A | 11/2018 |

OTHER PUBLICATIONS

Apr. 6, 2023 Office Action issued in Chinese Patent Application No. 202010672554.1.

* cited by examiner

IMPACT WRENCH

CROSS-REFERENCE TO RELATED APPLICATIONS

This application claims the benefit of priority to Japanese Patent Application No. 2019-157153, filed on Aug. 29, 2019, the entire contents of which are hereby incorporated by reference.

BACKGROUND

1. Technical Field

The present invention relates to an impact wrench.

2. Description of the Background

An impact wrench includes a spindle, a hammer, and an anvil as described in Japanese Unexamined Patent Application Publication No. 2018-183835. The rotation of the motor is transmitted to the spindle. The hammer is connected to the spindle with a cam via balls, and is urged frontward by a coil spring. The anvil is engaged with the hammer in the rotation direction and protrudes frontward. The anvil has a distal end formed into a rectangular prism with a rectangular cross section. The rectangular prism receives a socket, to which a bolt or a nut is fitted for fastening. As the anvil receives more torque under further fastening, the hammer is repeatedly engaged with and disengaged from the anvil, producing intermittent strikes (impacts) in the rotation direction.

BRIEF SUMMARY

In a known impact wrench, an anvil receives stress at an impact, with the edges of the rectangular prism firmly abutting against the inner surface of a rectangular hole in the socket in the rotation direction. Such stress particularly concentrates around the rectangular prism, possibly lowering the durability of the anvil around the edges over an extended period of use.

One or more aspects of the present invention are directed to an impact wrench including an anvil that receives less stress around a rectangular prism and has higher durability.

A first aspect of the present invention provides an impact wrench, including:

a motor;

a hammer rotatable by the motor;

a body accommodating the motor and the hammer; and an anvil protruding frontward from the body and configured to be struck in a rotation direction by the hammer, the anvil including a blade to be in contact with the hammer, a cylinder located frontward from the blade, a rectangular prism located frontward from the cylinder, at least one chamfered surface each at an edge of the rectangular prism, and a concave on a rear end of the at least one chamfered surface.

A second aspect of the present invention provides an impact wrench, including:

a motor;

a hammer rotatable by the motor;

a body accommodating the motor and the hammer; and an anvil protruding frontward from the body and configured to be struck in a rotation direction by the hammer, the anvil including a rectangular prism including a through-hole orthogonal to an axis of the anvil, four planes, and four chamfered surfaces each located between adjacent ones of the four planes, four curved surfaces located rearward from the four planes, and four concaves recessed on rear portions of the four chamfered surfaces and on rear portions of the four planes.

The impact wrench according to the above aspects includes the anvil that receives less stress around the rectangular prism and has higher durability.

DETAILED DESCRIPTION

Embodiments of the present invention will now be described with reference to the drawings.

Figure 1:
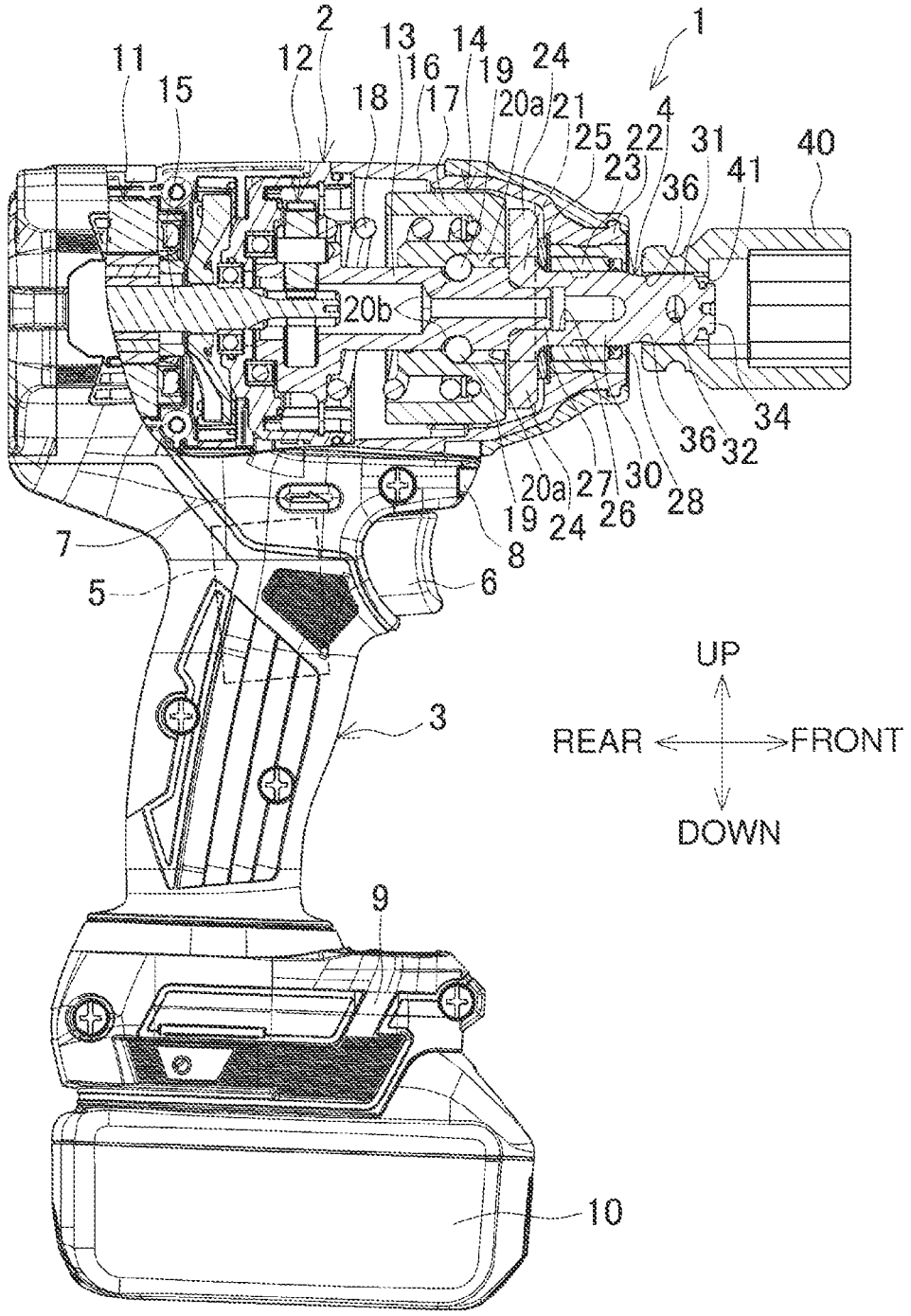
FIG. 1 is a longitudinal partial central sectional view of an impact wrench.

FIG. 1 is a longitudinal central sectional view of an example impact wrench.

An impact wrench 1 includes a body 2 and a handle 3. The body 2 extends in the front-rear direction. The handle 3 extends downward from the body 2. The body 2 accommodates a rear portion of an anvil 4. The anvil 4 has a front portion protruding frontward from the front end of the body 2.

A switch 5 is located above the handle 3, with a trigger 6 protruding frontward. A forward/reverse switch button 7 for switching the rotation direction of the anvil 4 is located above the switch 5. An illumination lamp 8 for illuminating ahead of the anvil 4 is located above the trigger 6. A battery mount 9 is located at the lower end of the handle 3. The battery mount 9 receives a battery pack 10, which serves as a power supply. The battery mount 9 accommodates a controller (not shown).

The body 2 accommodates, from the rear, a brushless motor 11, a reduction mechanism 12, a spindle 13, and an impact mechanism 14. The brushless motor 11 includes a rotational shaft 15. The reduction mechanism 12 reduces the rotation of the rotational shaft 15. The reduced rotation is transmitted to the spindle 13.

A hammer case 16 constitutes a front portion of the body 2. The hammer case 16 accommodates the impact mechanism 14. The impact mechanism 14 includes a hammer 17 and a coil spring 18. The hammer 17 is externally mounted on the spindle 13. The coil spring 18 urges the hammer 17 frontward.

The hammer 17 is connected to the spindle 13 in the rotation direction via balls 19 in between. The hammer 17 has a cam groove 20*a* on its inner peripheral surface. The spindle 13 has a cam groove 20*b* on its outer circumferential surface. The balls 19 are fitted between these cam grooves 20*a* and 20*b*. The coil spring 18 is externally mounted on the spindle 13 to urge the hammer 17 frontward. The hammer 17 includes a pair of tabs 21 on its front surface.

The anvil 4 is supported by a front cylinder 22 of the hammer case 16. The front cylinder 22 supports the anvil 4 coaxially with the spindle 13 via a metal bearing 23. An oil seal 28 is located frontward from the metal bearing 23. The oil seal 28 reduces external leakage of grease from inside the hammer case 16.

The anvil 4 has a pair of blades 24 extending radially on its rear end. The blades 24 engage with the tabs 21 on the hammer 17 in the rotation direction. The anvil 4 is positioned in the frontward direction with a regulation washer 25 between the front cylinder 22 and the blades 24. The anvil 4 has a blind hole 26 axially extending from the rear end. The blind hole 26 receives, at the rear, a smaller-diameter portion 27 of a front end of the spindle 13.

Figure 2:
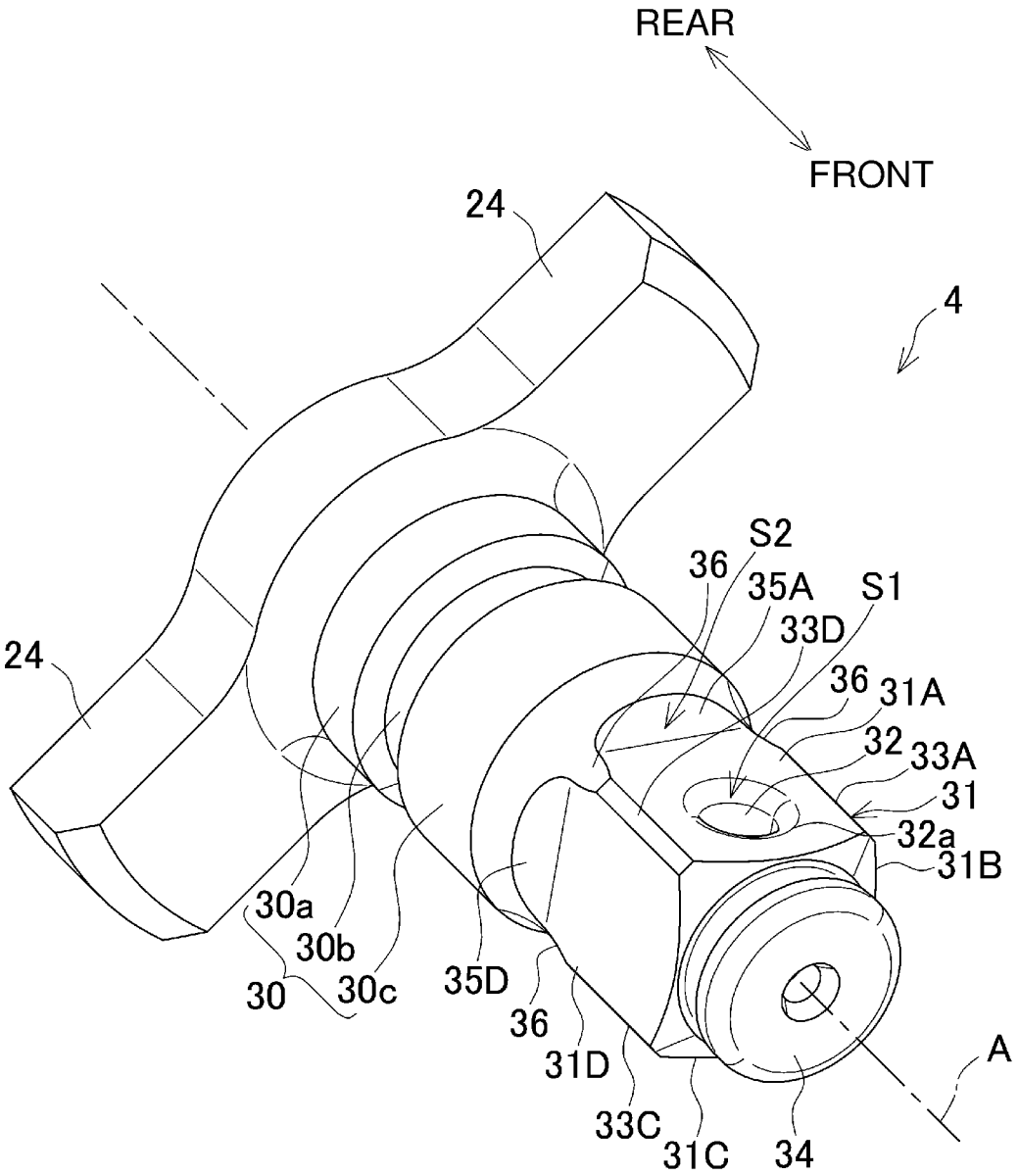
FIG. 2 is a perspective view of an anvil.

As shown in FIG. 2, the anvil 4 includes a cylinder 30 with a circular cross section frontward from the blades 24. The cylinder 30 includes a first cylinder 30*a*, a groove 30*b*, and a second cylinder 30*c*. The first cylinder 30*a* is located at the rear. The groove 30*b* is located frontward from the first cylinder 30*a*. The second cylinder 30*c* is located frontward from the groove 30*b*.

A rectangular prism 31 is located frontward from the cylinder 30. The rectangular prism 31 has a substantially rectangular cross section orthogonal to an axis A of the anvil 4. The rectangular prism 31 has four planes 31A to 31D.

The rectangular prism 31 receives a socket 40 with a rectangular hole 41 in a detachable manner. The rectangular prism 31 has a through-hole 32. The through-hole 32 receives a stopper pin for preventing the socket 40 from slipping off. The through-hole 32 has openings 32*a* in two parallel planes 31A and 31C of the rectangular prism 31. As shown in FIG. 2, first stress concentration portions S1 that are the first portions to receive concentrated stress are defined around the openings 32*a*.

The four edges between the planes 31A to 31D include chamfered surfaces 33A to 33D. The chamfered surfaces 33A to 33D are narrow and are elongated in a direction of the axis A of the anvil 4. The rectangular prism 31 thus has the planes 31A to 31D, the chamfered surfaces 33A to 33D, and the through-hole 32.

The anvil 4 includes, at its front end, a narrower-diameter portion 34 frontward from the rectangular prism 31. The narrower-diameter portion 34 holds an annular elastic member (not shown) for preventing the socket 40 from slipping off.

The planes 31A to 31D have rear ends meeting four curved surfaces 35A to 35D that are continuous with the planes 31A to 31D. The curved surfaces 35A to 35D each have a radius (first radius) of about 2 mm. As shown in FIG. 2, second stress concentration portions S2 that are the second portions to receive concentrated stress are defined around a boundary L (FIG. 3B) between the rectangular prism 31 and the curved surfaces 35A to 35D and adjacent to the openings of the through-hole 32.

As shown in FIGS. 3B and 5B to 5D, the chamfered surfaces 33A to 33D have rear ends meeting concaves 36. The concaves 36 are each recessed from the front outer portions of the chamfered surfaces 33A to 33D toward the axis A of the anvil 4.

Figure 3A:
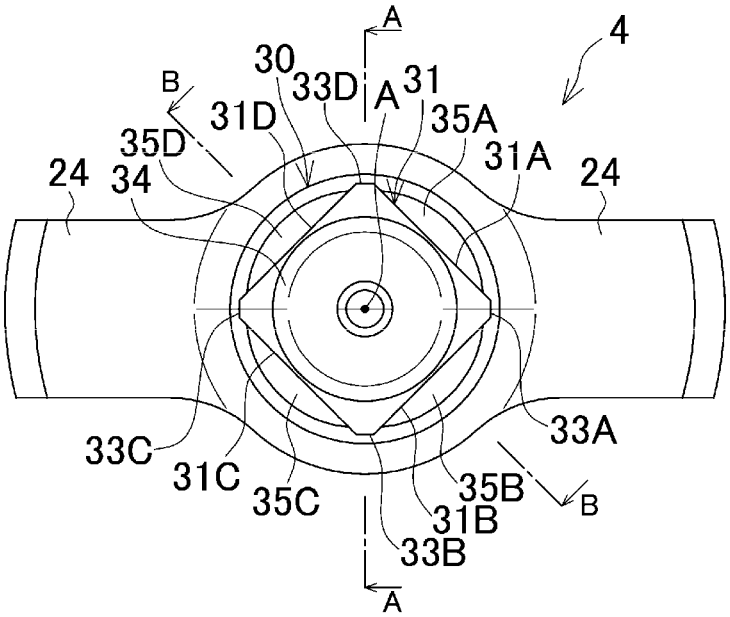
FIG. 3A is a front view of the anvil.
Figure 3B:
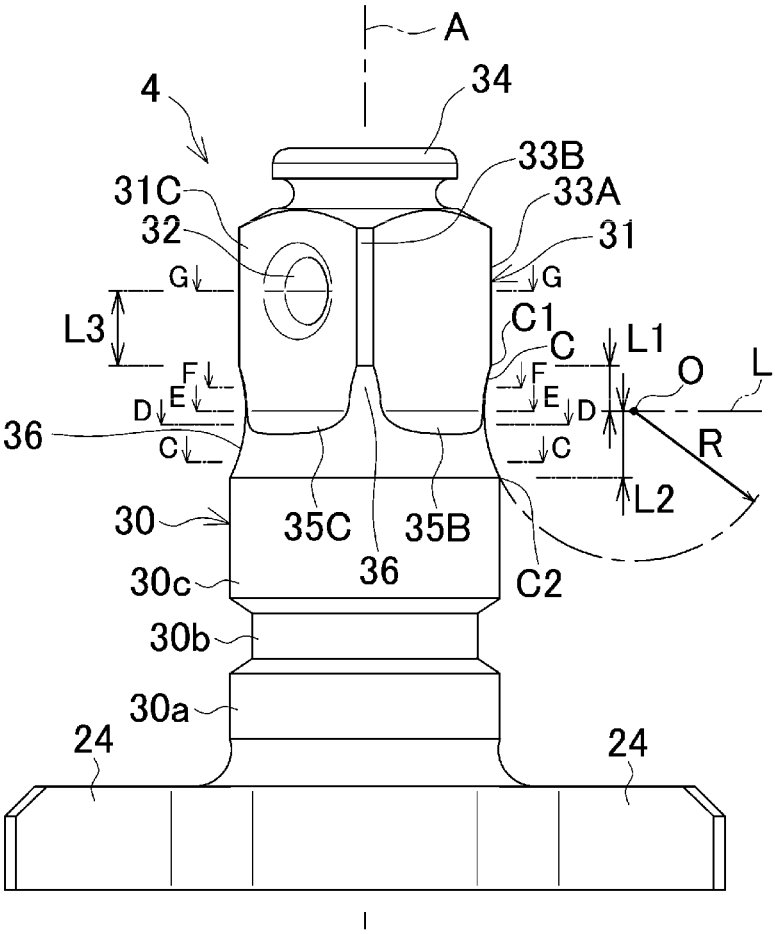
FIG. 3B is a side view of the anvil.

Each concave 36 is an arc-shaped cutout along an arc C with a center O. As shown in FIG. 3B, the arc C has a front concave-end C1 and a rear concave-end C2 recessed on the outer surface of the anvil 4.

The center O is located between the front concave-end C1 and the rear concave-end C2 in the direction of the axis A. The front concave-end C1 is at a distance L1 from the boundary L. The rear concave-end C2 is at a distance L2 from the boundary L. The radial position of the center O from the axis A is defined by the arc C with a predetermined radius (second radius) R. The radius R is about 10 mm in this embodiment.

The arc C with a predetermined radius R passes through the front concave-end C1 and the rear concave-end C2. Any change in the distance L2 is less likely to affect the stress applied to around the rectangular prism 31.

At the rear of the rectangular prism 31, the concaves 36, which are recessed on the planes 31A to 31D, each have the length equal to the distance L1 between the front end (boundary L) of the curved surfaces 35A to 35D and the front concave-end C1 of the arc C in the direction of the axis A. The concaves 36 do not come in contact with the inner surface of the rectangular hole 41 in the socket 40. The stress applied to around the rectangular prism 31 thus varies depending on the length L1 of each concave 36. Preferably, the rear concave-end C2 may be located frontward from the oil seal 28 to avoid degrading grease sealing using the oil seal 28.

Figure 4B:
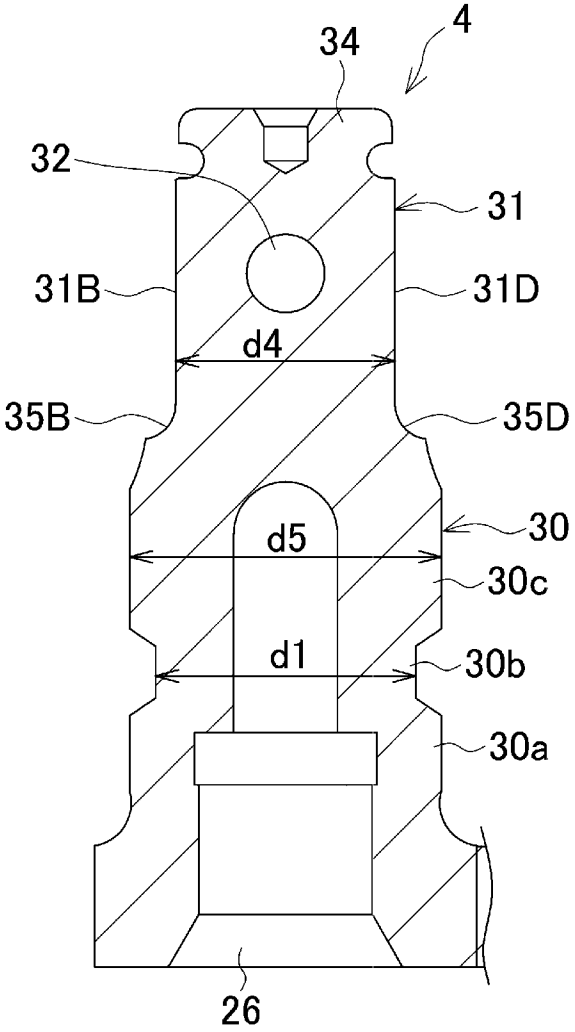
FIG. 4B is a cross-sectional view taken along line B-B in FIG. 3A.
Figure 4A:
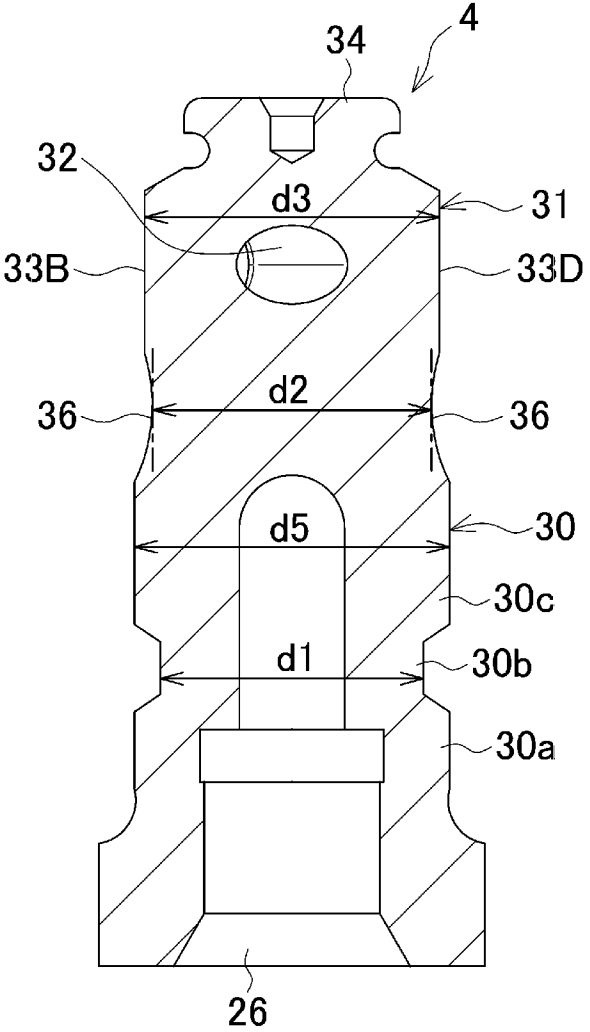
FIG. 4A is a cross-sectional view taken along line A-A in FIGS. 3A and 3B.
Figure 5A:
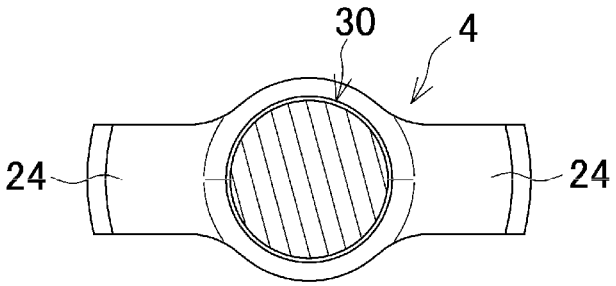
FIG. 5A is a cross-sectional view taken along line C-C in FIG. 3B.
Figure 5B:
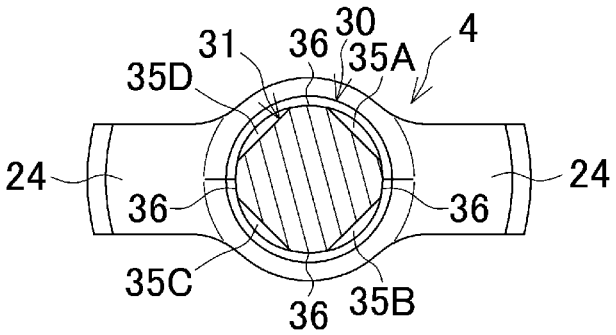
FIG. 5B is a cross-sectional view taken along line D-D in FIG. 3B.
Figure 5C:
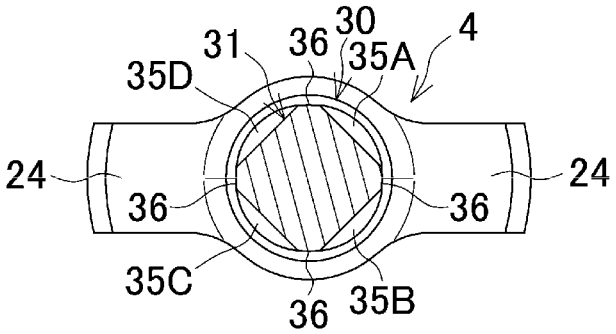
FIG. 5C is a cross-sectional view taken along line E-E in FIG. 3B.
Figure 5D:
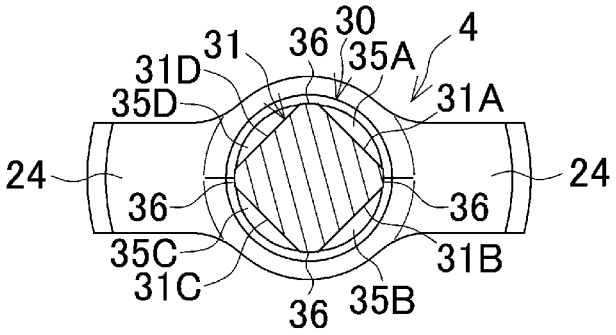
FIG. 5D is a cross-sectional view taken along line F-F in FIG. 3B.
Figure 5E:
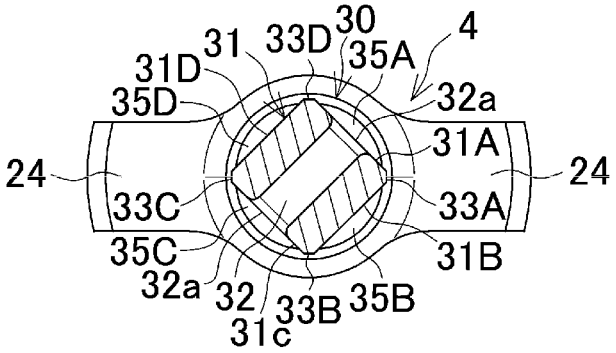
FIG. 5E is a cross-sectional view taken along line G-G in FIG. 3B.
Figure 6A:
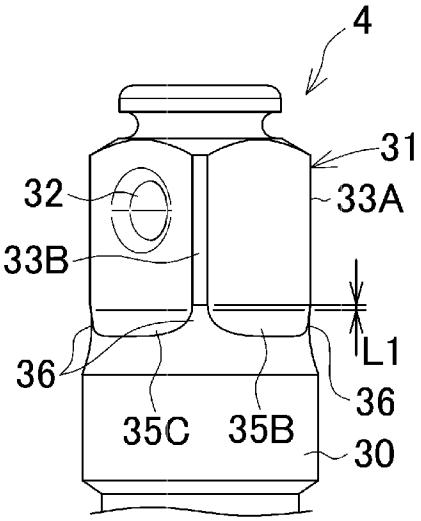
FIG. 6A is a diagram describing a rectangular prism having a concave with a length of 0.4 mm.
Figure 6B:
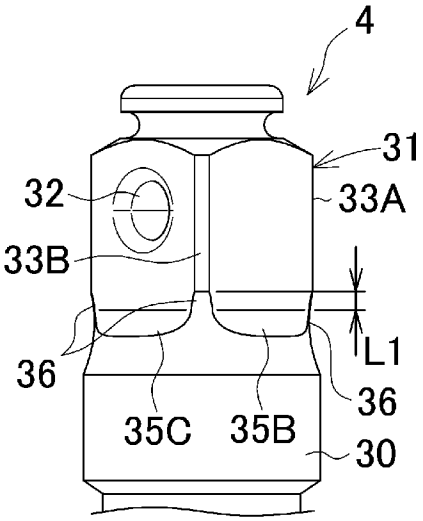
FIG. 6B is a diagram describing a rectangular prism having a concave with a length of 1.4 mm.
Figure 6C:
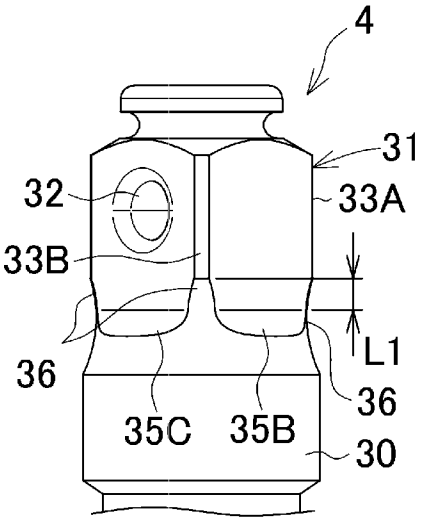
FIG. 6C is a diagram describing a rectangular prism having a concave with a length of 2.4 mm.
Figure 6D:
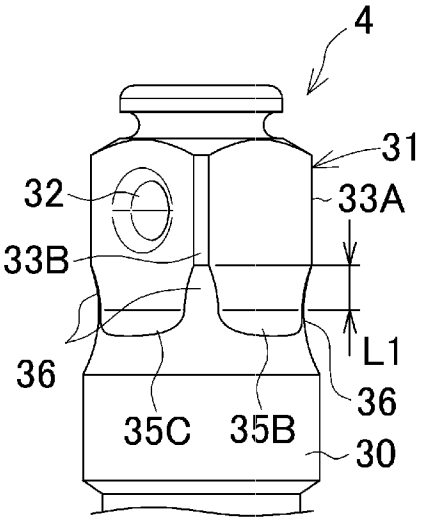
FIG. 6D is a diagram describing a rectangular prism having a concave with a length of 3.4 mm.

As shown in FIG. 4A, the groove 30*b* rearward from the concaves 36 has a diameter d1 (15.0 mm in this embodiment) smaller than a diameter d2 (15.9 mm in this embodiment) of the anvil 4 in the deepest portions of the concaves 36. The diameter d1 of the groove 30*b* is also smaller than a distance d3 (16.8 mm in this embodiment) between the two chamfered surfaces 33B and 33D (or between 33A and 33C) facing each other with the axis A in between.

As shown in FIG. 4B, the diameter d1 of the groove 30*b* is larger than the distance between the two planes 31B and 31D (or between 31A and 31C) facing each other with the axis A in between, or in other words, larger than a width-across-flats d4 (12.7 mm in this embodiment) of a flat portion. The first cylinder 30*a* and the second cylinder 30*c* have the same diameter d5 (18.0 mm in this embodiment).

The diameters d1 to d5 are not limited to the above values, and may be varied within substantially ±0.3 mm.

FIGS. 6A to 6D show the rectangular prisms 31 having the concaves 36 with four different lengths L1. The length L1 is 0.4 mm in FIG. 6A, 1.4 mm in FIG. 6B, 2.4 mm in FIG. 6C, and 3.4 mm in FIG. 6D.

Figure 7:
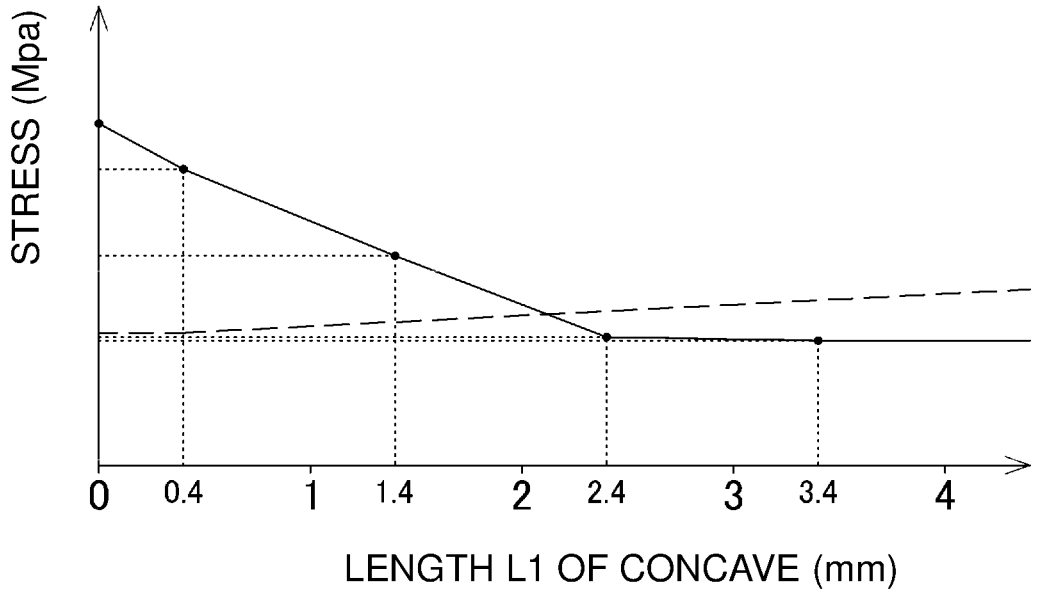
FIG. 7 is a graph showing the relationship between the length of a concave and stress.

FIG. 7 is a graph showing the relationship between the length L1 (mm) of the concave 36 and the stress (Mpa). The solid line indicates varying stress in the second stress concentration portions S2 in accordance with the change in length of the concave 36. The dotted line indicates varying stress at the openings 32*a* of the through-hole 32 (first stress concentration portions S1) in accordance with the change in length of the concave 36.

The stress in the second stress concentration portions S2 gradually decreases as the concave 36 has a larger length compared with the corresponding length (L1=0) in a known structure with no concave. The reduction rate (slope) is larger or steeper as the length of the concave 36 is smaller. However, when the length of the concave 36 exceeds 2.4 mm, the stress decreases slightly as the concave 36 has a larger length.

The stress in the first stress concentration portion S1 gradually increases as the length of the concave 36 increases. The rate of increase in the stress is substantially constant across all the lengths of the concave 36.

Based on such relationship and the stress on the through-hole 32, the concave 36 may have the length L1 of 2.0 to 3.0 mm, or more specifically 2.0 to 2.5 mm.

To prevent the through-hole 32 from receiving more stress, the distance L3 (FIG. 3B) between the centerline of the through-hole 32 and the front end of the concave 36 may be larger than or equal to 4.5 mm, or more specifically 4.5 to 5.0 mm in the direction of the axis A.

The impact wrench 1 according to the present embodiment is operable with a hand holding the handle 3 to press the trigger 6 by a finger. The switch 5 is then turned on, causing the battery pack 10 to power the brushless motor 11 to rotate. The rotational shaft 15 then rotates to rotate the spindle 13 with reduced rotation through the reduction mechanism 12. The hammer 17 rotates via the balls 19 as the spindle 13 rotates. As the hammer 17 rotates, the anvil 4 also rotates, allowing fastening of, for example, a bolt using the socket 40.

When the anvil 4 receives more torque under further fastening, the hammer 17 retracts against the urging force from the coil spring 18. More specifically, the hammer 17 retracts while rolling the balls 19 rearward along the cam groove 20. When the tabs 21 are disengaged from the blades 24, the hammer 17 advances while rotating along the cam groove 20 under the urging force from the coil spring 18. Then, the tabs 21 are re-engaged with the blades 24 to cause the anvil 4 to produce a rotational striking force (impact). The impact is intermittently produced repeatedly, fastening the bolt more firmly.

At the impact, the chamfered surfaces 33A to 33D of the rectangular prism 31 of the anvil 4 come in contact with the inner surface of the rectangular hole 41 in the socket 40. This applies stress on the rectangular prism 31. However, the chamfered surfaces 33A to 33D have the concaves 36 on their rear ends. The concaves 36, which are not in contact with the inner surface of the rectangular hole 41, remove the stress. The stress applied to around the rectangular prism 31 is thus reduced.

The impact wrench 1 according to the present embodiment includes the body 2, the anvil 4 protruding from the body 2, the hammer 17 that strikes the anvil 4 in the rotation direction, and the brushless motor 11 (motor) for rotating the hammer 17. The anvil 4 includes the blades 24 to be in contact with the hammer 17, the cylinder 30 located frontward from the blades 24, the rectangular prism 31 located frontward from the cylinder 30, and the chamfered surfaces 33A to 33D on the edges of the rectangular prism 31 in the direction of the axis A of the anvil 4. The concaves 36 are located on the rear ends of the chamfered surfaces 33A to 33D.

The anvil 4 includes the rectangular prism 31, the four curved surfaces 35A to 35D, and the four concaves 36. The rectangular prism 31 includes the through-hole 32 orthogonal to the axis A of the anvil 4, the four planes 31A to 31D, and the four chamfered surfaces 33A to 33D located between the planes 31A to 31D. The four curved surfaces 35A to 35D are located rearward from the four planes 31A to 31D. The four concaves 36 are recessed on the rear portions of the four chamfered surfaces 33A to 33D and on the rear portions of the planes 31A to 31D.

This structure reduces stress applied to around the rectangular prism 31 to improve the durability of the anvil 4.

The concave 36 is recessed in an arc shape along the arc C with the center located radially outward from the anvil 4 in the direction of the axis A of the anvil 4. This structure is less likely to receive stress concentration.

The concave 36 has the length L1 of 2.0 to 2.5 mm between its deepest portion and the front end in the direction of the axis A. This structure thus reduces stress applied to around the rectangular prism 31 without increasing stress at the through-hole 32.

The concaves 36 are located frontward from the oil seal 28. The concaves 36 thus do not cause leakage of grease.

The curved surfaces and the concaves may not be arc-shaped. For example, the curved surfaces and the concaves may be recessed in semicircular or semielliptical shapes, or may be recessed in triangular or squared C shapes. The depth and the length of each concave may be modified as appropriate, in addition to the above embodiments.

The rectangular prism, the cylinder, and the blades may also be modified in any shapes. The through-hole in the rectangular prism may not be formed. The narrower-diameter portion may be eliminated. When the rectangular prism can receive a socket, the planes of the rectangular prism may not be precisely flat, but may have some curves or irregularities on the surface.

The motor may not be a brushless motor. The impact wrench may be powered by an alternating current (AC), rather than using a battery pack.

REFERENCE SIGNS LIST

1 impact wrench
2 body
3 handle
4 anvil
11 brushless motor
13 spindle
14 impact mechanism
15 rotational shaft
17 hammer
24 blade
30 cylinder
31 rectangular prism
31A to 31D plane
33A to 33D chamfered surface
36 concave
40 socket
A axis of anvil
L1 length of concave
S1 first stress concentration portion
S2 second stress concentration portion

What is claimed is:

1. An impact wrench, comprising:

a motor;

a hammer rotatable by the motor;

a body accommodating the motor and the hammer; and an anvil (i) protruding frontward from the body, (ii) configured to be struck in a rotation direction by the hammer and (iii) including a blade configured to be contacted by the hammer, a cylinder frontward from the blade, a rectangular prism (i) frontward from the cylinder and (ii) including a plurality of planes, and a plurality of chamfered surfaces, each of the plurality of chamfered surfaces is between adjacent ones of the plurality of planes, a plurality of curved surfaces, each of the plurality of curved surfaces is rearward from, is continuous with, and curves outwardly from one of the plurality of planes, and a plurality of concaves recessed at rear portions of the plurality of chamfered surfaces and rear portions of the plurality of planes, each of the plurality of concaves having a rear end rearward from a rear end of the plurality of curved surfaces, wherein the each of the plurality of concaves has a front end located frontward from a front end of the plurality of curved surfaces.

2. The impact wrench according to claim 1, wherein the each of the plurality of concaves is recessed from an outer portion of the plurality of chamfered surfaces.

3. The impact wrench according to claim 2, wherein the each of the plurality of concaves is recessed in an arc shape along an arc having a center radially outward from the anvil in a direction of an axis of the anvil.

4. The impact wrench according to claim 2, wherein the each of the plurality of concaves has a length of 2.0 to 2.5 mm from a boundary between the cylinder and the rectangular prism to a front end of the each of the plurality of concaves in a direction of an axis of the anvil, and the rectangular prism includes a flat portion with a width-across-flats of 12.4 to 13.0 mm.

5. The impact wrench according to claim 2, wherein the rectangular prism has a through-hole orthogonal to an axis of the anvil.

6. The impact wrench according to claim 2, wherein the plurality of chamfered surfaces includes four chamfered surfaces of the rectangular prism.

7. The impact wrench according to claim 1, wherein the each of the plurality of concaves is recessed in an arc shape along an arc having a center radially outward from the anvil in a direction of an axis of the anvil.

8. The impact wrench according to claim 7, wherein the each of the plurality of concaves has a length of 2.0 to 2.5 mm from a boundary between the cylinder and the rectangular prism to a front end of the concave in a direction of an axis of the anvil, and the rectangular prism includes a flat portion with a width-across-flats of 12.4 to 13.0 mm.

9. The impact wrench according to claim 1, wherein the each of the plurality of concaves has a length of 2.0 to 2.5 mm from a boundary between the cylinder and the rectangular prism to a front end of the each of the plurality of concaves in a direction of an axis of the anvil, and the rectangular prism includes a flat portion with a width-across-flats of 12.4 to 13.0 mm.

10. The impact wrench according to claim 1, wherein the rectangular prism has a through-hole orthogonal to an axis of the anvil.

11. The impact wrench according to claim 10, wherein a distance between a centerline of the through-hole and a front end of the each of the plurality of concaves is larger than or equal to 4.5 mm in a direction of the axis of the anvil, and the cylinder has a diameter of 17.7 to 18.3 mm.

12. The impact wrench according to claim 1, wherein the plurality of chamfered surfaces includes four chamfered surfaces of the rectangular prism.

13. An impact wrench, comprising:

a motor;

a hammer rotatable by the motor;

a body accommodating the motor and the hammer; and an anvil (i) protruding frontward from the body, (ii) configured to be struck in a rotation direction by the hammer and (iii) including a rectangular prism including a through-hole orthogonal to an axis of the anvil, four planes, and four chamfered surfaces, each of the four chamfered surfaces is between adjacent ones of the four planes, four curved surfaces, each of the four curved surfaces is rearward from, is continuous with, and curves outwardly from one of the four planes, and four concaves recessed at rear portions of the four chamfered surfaces and at rear portions of the four planes, each of the four concaves having a rear end located rearward from a rear end of the four curved surfaces, wherein the each of the four concaves has a front end located frontward from a front end of the each of the four curved surfaces.

14. The impact wrench according to claim 13, wherein each of the four curved surfaces defines a part of a circle with a first radius.

15. The impact wrench according to claim 14, wherein each of the four concaves has an arc shape with a second radius different from the first radius.

16. The impact wrench according to claim 13, further comprising:

a hammer case accommodating the hammer;

a bearing in the hammer case and holding the anvil in a rotatable manner; and an oil seal located frontward from the bearing, wherein the four concaves are frontward from the oil seal.

17. The impact wrench according to claim 13, wherein the anvil has a groove rearward from the four concaves, and the groove has a diameter smaller than a distance between two of the four chamfered surfaces facing each other with a longitudinal axis of the anvil in between and larger than a distance between two of the four planes facing each other with the longitudinal axis of the anvil in between.

18. The impact wrench according to claim 13, wherein the anvil has a groove rearward from the four concaves, and the groove has a diameter smaller than a diameter of the anvil in deepest portions of the four concaves.

* * * * *